US009884753B1

(12) United States Patent
Juarez

(10) Patent No.: US 9,884,753 B1
(45) Date of Patent: Feb. 6, 2018

(54) MULTI-COMPARTMENT BEVERAGE COOLER

(71) Applicant: Michael A. Juarez, Williams, AZ (US)

(72) Inventor: Michael A. Juarez, Williams, AZ (US)

( * ) Notice: Subject to any disclaimer, the term of this patent is extended or adjusted under 35 U.S.C. 154(b) by 0 days.

(21) Appl. No.: 15/169,034

(22) Filed: May 31, 2016

(51) Int. Cl.
*B65D 81/38* (2006.01)
*B67D 3/00* (2006.01)

(52) U.S. Cl.
CPC ..... *B67D 3/0061* (2013.01); *B67D 3/0009* (2013.01); *B67D 3/0096* (2013.01)

(58) Field of Classification Search
CPC .. B67D 3/0061; B67D 3/0009; B67D 3/0096; F25D 31/002; F25D 3/08; B65D 1/24
USPC ..... 222/129, 185.1, 146.6, 131, 132, 135; 220/553, 737, 739, 903
See application file for complete search history.

(56) References Cited

U.S. PATENT DOCUMENTS 1,019,732 A * 3/1912 Borochow ..... B65F 1/004 220/212.5
1,830,144 A * 11/1931 Venago ..... A47G 19/30 222/129
3,052,368 A * 9/1962 Atkins ..... A47J 47/02 215/10
3,971,304 A 7/1976 Cvitkovich
4,274,262 A 6/1981 Reed
4,608,837 A * 9/1986 Hickey ..... B65D 25/04 62/390
5,328,050 A 7/1994 Hyatt
5,535,883 A * 7/1996 Henderson ..... F25D 3/08 206/139
D491,408 S 6/2004 Clark
7,269,969 B2 9/2007 Strickland
7,350,671 B2 4/2008 Mika
7,461,761 B2 * 12/2008 Hildreth ..... A47K 5/12 222/173
7,806,298 B2 * 10/2010 Kraus ..... B65D 25/04 222/129
8,123,069 B1 * 2/2012 Mumaw ..... B67D 3/0061 220/23.4
D655,562 S 3/2012 Schenik
9,469,451 B2 * 10/2016 Dunn ..... A47G 19/02
2001/0035430 A1 * 11/2001 Litscher ..... A45D 34/00 222/94
2009/0241584 A1 * 10/2009 Hayes ..... B67D 3/0009 62/390
2010/0212351 A1 * 8/2010 Chapin ..... F25D 3/08 62/457.5

* cited by examiner

*Primary Examiner* — Charles P Cheyney

(57) ABSTRACT

The multi-compartment beverage cooler is a portable insulated beverage cooler that is divided into a plurality of beverage chambers each of which is capable of containing storing multiple beverages and keeping them cool. The multi-compartment beverage cooler is comprised of a body, a divider structure, a plurality of dispensing spouts, and a removable lid.

1 Claim, 5 Drawing Sheets

MULTI-COMPARTMENT BEVERAGE COOLER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of camping and sporting goods, more specifically, a beverage cooler configured to separately hold multiple beverages.

SUMMARY OF INVENTION

The multi-compartment beverage cooler is a portable insulated beverage cooler that is divided into a plurality of beverage chambers each of which is capable of containing separate beverages and keeping them cool. The multi-compartment beverage cooler is comprised of a body, a divider structure, a plurality of dispensing spouts, and a removable lid.

These together with additional objects, features and advantages of the multi-compartment beverage cooler will be readily apparent to those of ordinary skill in the art upon reading the following detailed description of the presently preferred, but nonetheless illustrative, embodiments when taken in conjunction with the accompanying drawings.

In this respect, before explaining the current embodiments of the multi-compartment beverage cooler in detail, it is to be understood that the multi-compartment beverage cooler is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the multi-compartment beverage cooler.

It is therefore important that the claims be regarded as including such equivalent construction insofar as they do not depart from the spirit and scope of the multi-compartment beverage cooler. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
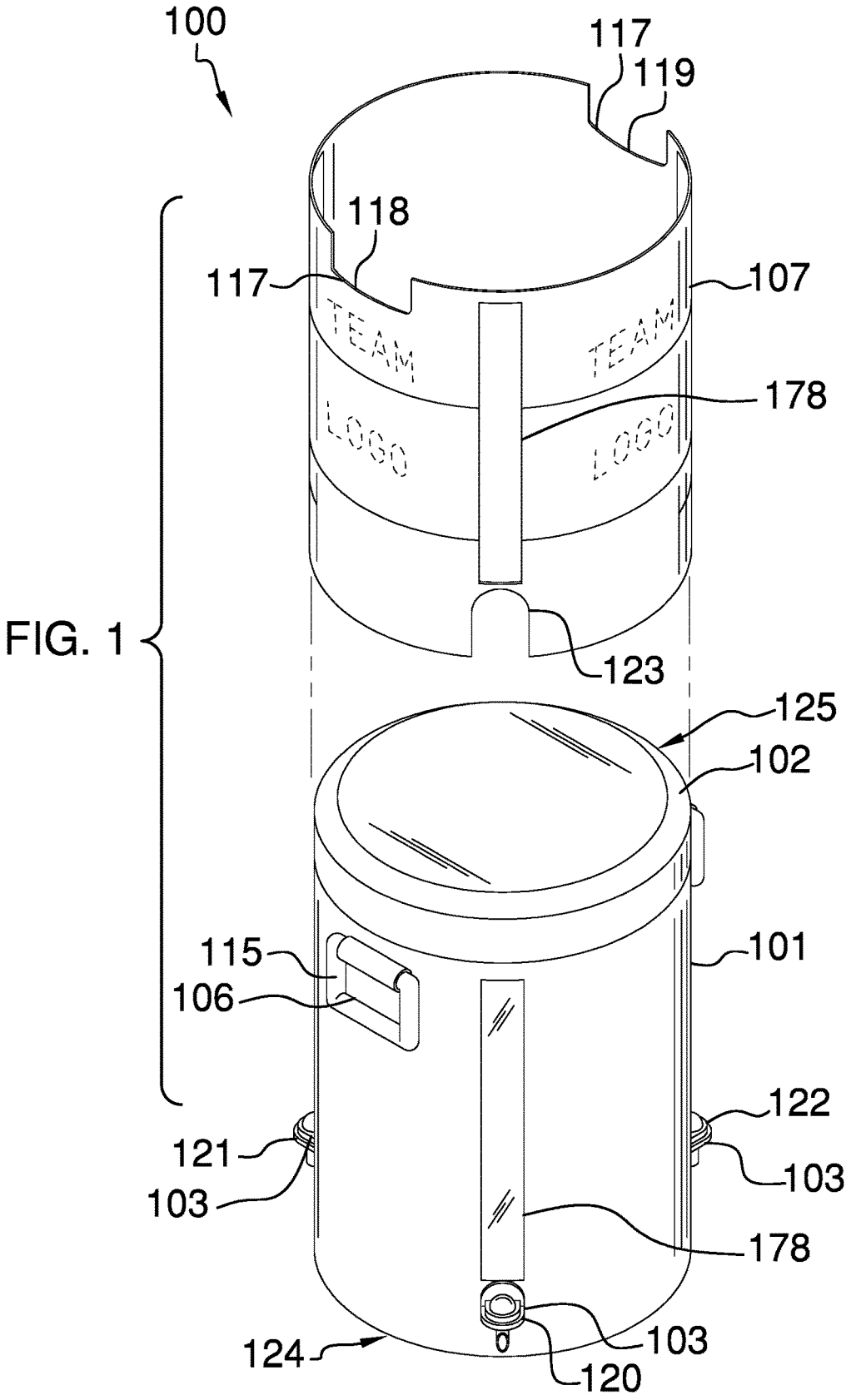
FIG. 1 shows a perspective view of the multi-compartment beverage cooler.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As illustrated in FIGS. 1-5, the multi-compartment beverage cooler (hereinafter invention 100) is comprised of a body 101, a divider structure 105, a plurality of dispensing spouts 103, a removable lid 102, and an optional customizable outer sleeve 107.

The body 101 is essentially formed in the shape of a cylinder which is comprised of a body sidewall 108 forming a curved outer surface, a top 125, a bottom 124, a length 126, and a diameter 127. The top 125 of the body 101 is open. When in use, the invention 100 is placed so that the bottom 124 is substantially in contact with a resting surface. The bottom 124 and body sidewall 108 provide for the exterior containment of the beverages within the invention 100. The body sidewall 108 and bottom 124 are each made of a hard inner plastic shell 128, a hard outer plastic shell 129, and core insulating material 130, which is sandwiched within the hard inner plastic shell 127 and hard outer plastic shell 128.

The divider structure 105 is used to divide the interior volume of the body 101 to form a plurality of beverage chambers 104. Each individual beverage chamber 104 is adapted to store a beverage therein. Moreover, each of the plurality of beverage chambers are independent of one another, and keep the various beverages separated from one another.

The divider structure 105 is comprised of a plurality of panels 134. The width of each of the plurality of panels 134 spans a radius or half of the diameter 127 of the invention 100. The length of each of the plurality of panels 134 runs in the direction of the length 126 of the invention 100. The individual length of each of the plurality of panels 134 is less than or equal to the overall length 126 of the invention 100. Any two adjacent panels from the plurality of panels 134 will provide the inner containment for each individual beverage chamber 104.

Figure 2:
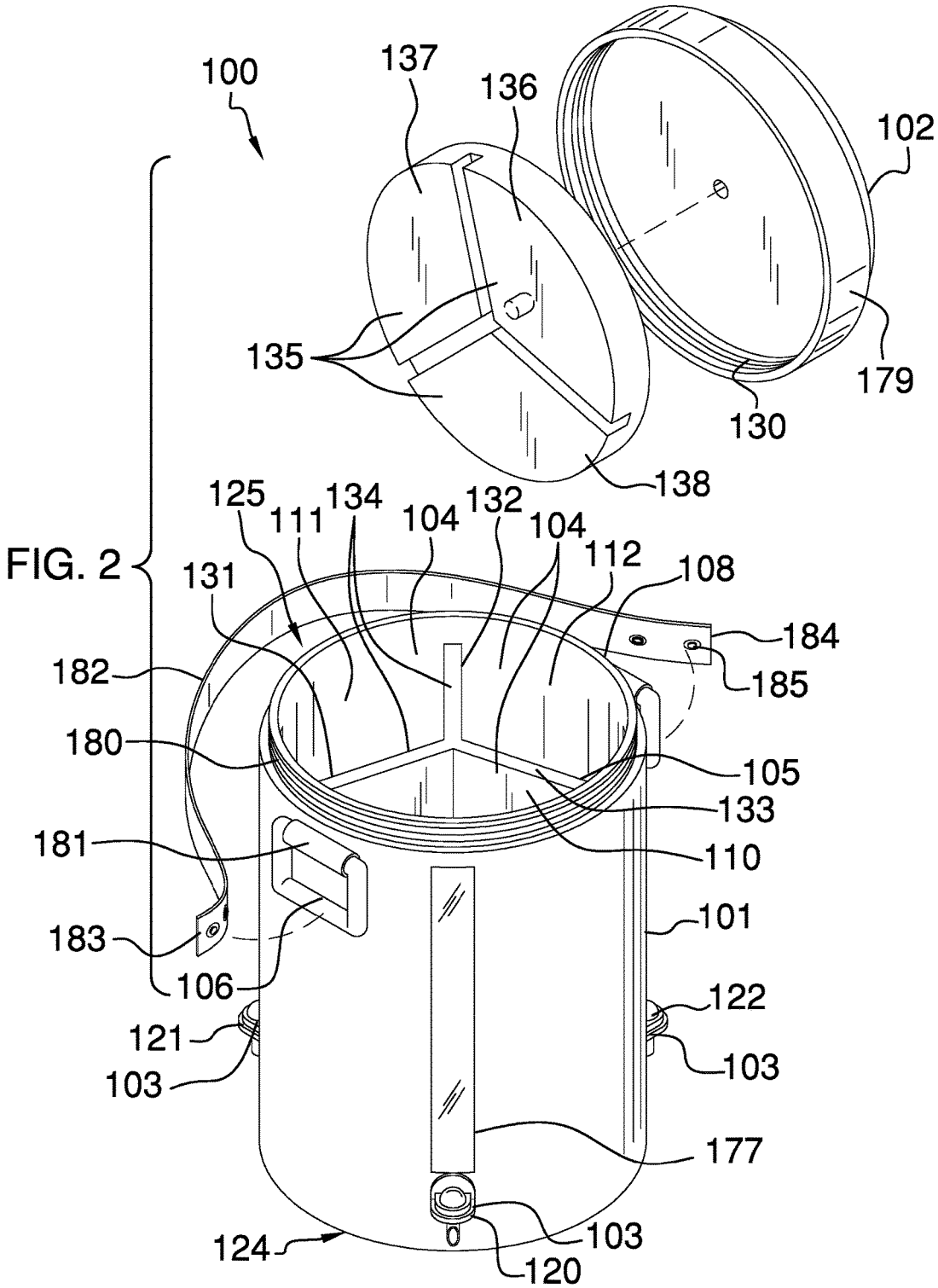
FIG. 2 shows a perspective view of the interior of the invention.
Figure 3:
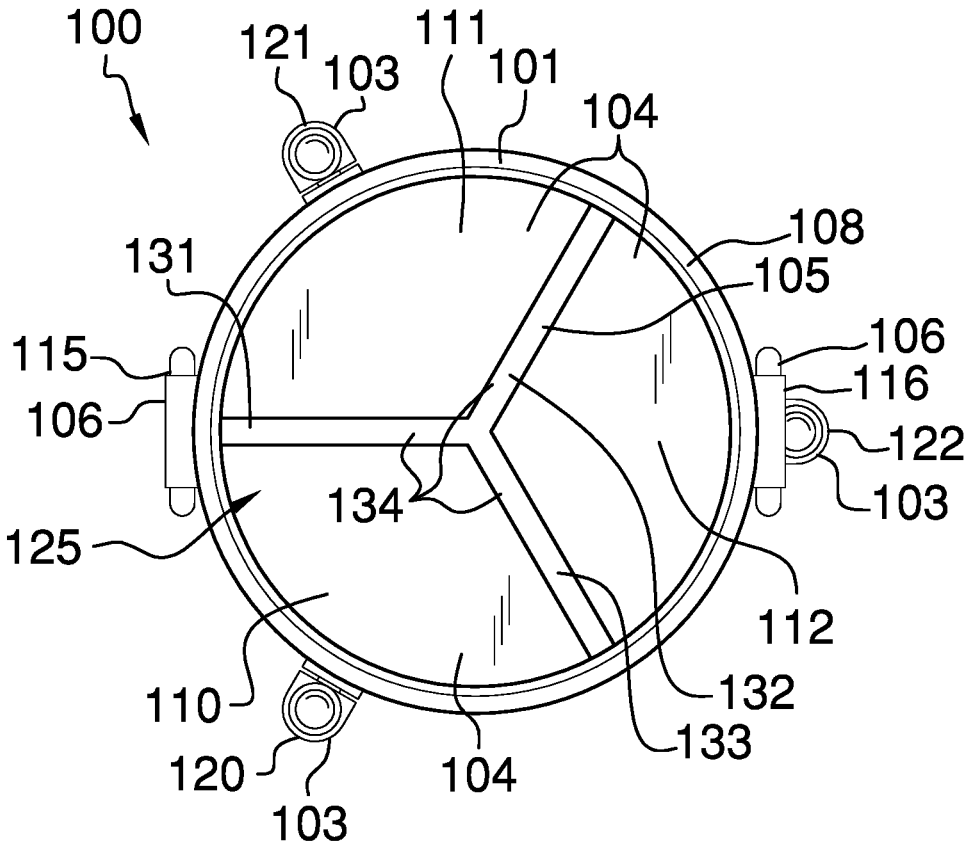
FIG. 3 shows a top view of the invention.
Figure 4:
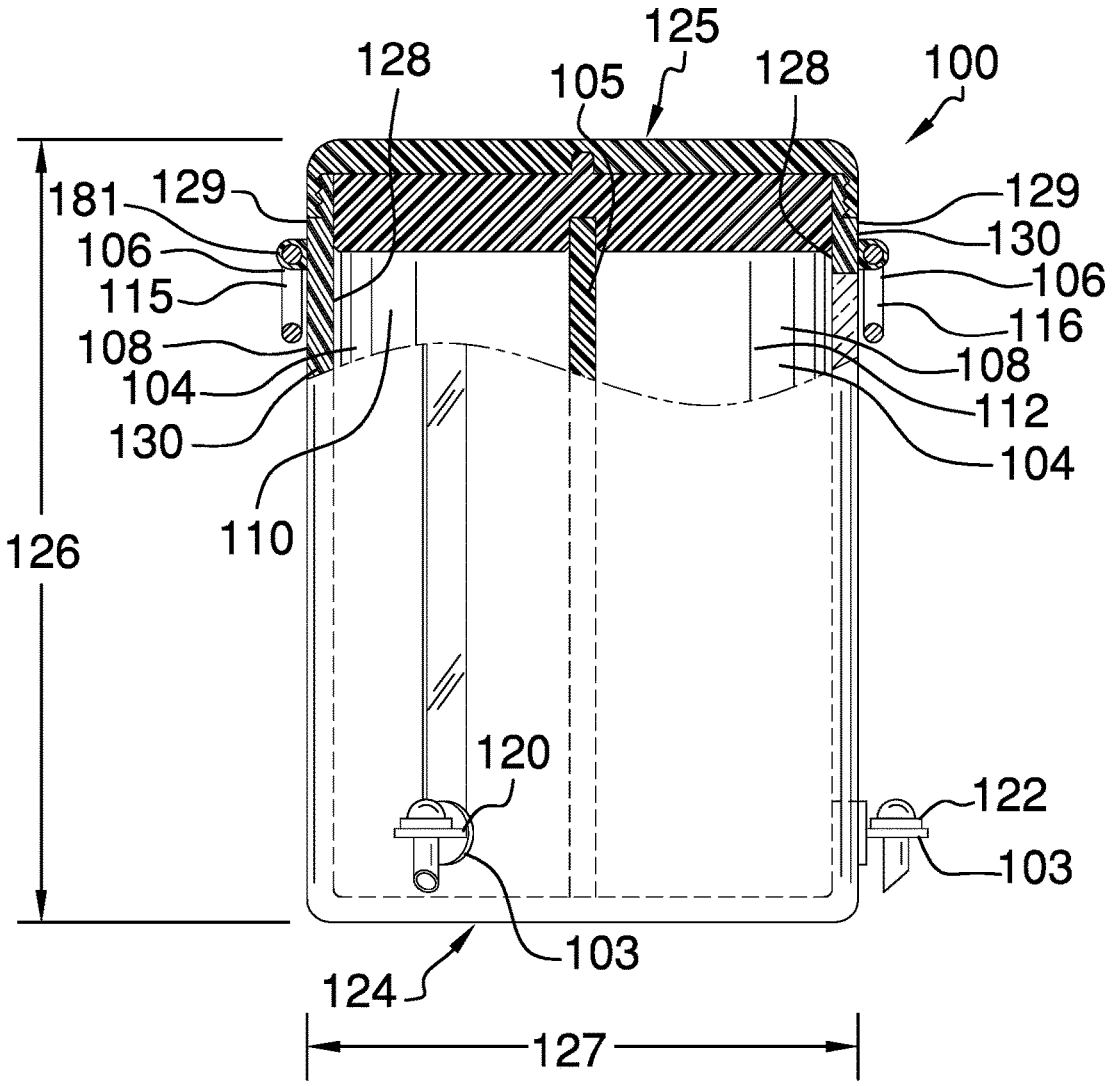
FIG. 4 show a partial cut-away view of the invention.

In a first illustrative embodiment shown in FIGS. 1, 2 and 3, the divider structure 105 is used to segregate the interior volume of the body 101 into a first beverage chamber 110, a second beverage chamber 111 and a third beverage chamber 112. The divider structure 105 is comprised of a first panel 131, a second panel 132 and a third panel 133. In this embodiment, the first panel 131 and third panel 112 combine to form the inner walls of the first beverage chamber 110, the first panel 131 and second panel 132 combine to form the inner walls of the second beverage chamber 111, and the second panel 132 and third panel 133 combine to form the inner walls of the third beverage chamber 112.

The divider structure 105 is made of a hard plastic shell filled with a core insulating material 130. Each panel of the divider structure 105 is attached to the sidewall 108 and the bottom of the invention 124. In a second illustrative embodiment, the divider structure 105 and hard inner plastic shell 128 are formed as a single piece of molded plastic and the hard outer plastic shell 129 is formed as a separate piece of molded plastic. In this second embodiment, the hard inner plastic shell 128/divider structure 105 combination is attached to the hard outer plastic shell 129. The core insulating material 130 is then injected into the space created between the hard inner plastic shell 128/divider structure 105 combination and the hard outer plastic shell 129. An example of a suitable material for the hard outer plastic shell 129 would be high density polyethylene. An example of suitable material for the divider structure 105 and the hard inner plastic shell 129 would be food grade polypropylene. An example of suitable material for the core insulating material would be polystyrene or urethane foam.

A plurality of dispensing spouts 103 is provided with the invention 100. Specifically, each of the plurality of beverage chambers 104 is provided with one of the plurality of dispensing spouts 103. The plurality of dispensing spouts is adapted to enable removal of the beverage from the respective beverage chamber 104. Each individual dispensing spout 103, which can be, but is not limited to, a faucet, tap or stopcock, is mounted through the body sidewall 108 and controls the flow of liquid from each individual beverage container 104 into an external container.

As shown in the first illustrative embodiment illustrated in FIGS. 1, 2 and 3, a first dispensing spout 120 controls the flow of liquid from the first beverage chamber 110, a second dispensing spout 121 controls the flow of liquid from the second beverage chamber 111, and a third dispensing spout 122 controls the flow of liquid from the third beverage chamber 112. The plurality of dispensing spouts 103 can be made of molded plastic. An example of suitable material for a dispensing spout 103 is food grade polypropylene.

The invention 100 is provided with a removable lid 102. The removable lid 102 is sized and designed for the purpose of sealing and insulating the open top 125 of the body 101. The removable lid 102 is designed to enclose the open top 125 of the body 101 with a plurality of beverage chamber seals 135 nested within.

As shown in the first illustrative embodiment represented in FIGS. 1, 2 and 3, a first beverage chamber seal 136 will fit securely in the first beverage chamber 110, a second beverage chamber seal 137 will fit securely in the second beverage chamber 111, and a third beverage chamber seal 138 will fit securely in the third beverage chamber 112. The plurality of beverage chamber seals 135 comprises the first beverage chamber seal 136, the second beverage chamber seal 137, and the third beverage chamber seal 138.

The removable lid 102 can be made from a third piece molded plastic with a hollow space in the center. The removable lid 102 may be further defined with an internal threading 130 provided within a lip 179 of the removable lid 102. The internal threading 130 of the lip 179 of the removable lid 102 corresponds with external threading 180 provided at the top 125 of the body 101. An example of suitable material for the third piece of molded plastic would be food grade polypropylene.

Optionally, the body 101 can be fitted with a plurality of handgrips 106. The plurality of handgrips 106 are provided adjacent to and below the external threading 180 at the top 125 of the body 101. As shown in the first illustrative embodiment represented in FIGS. 1 through 5, the plurality of handgrips 106 is further defined as a first handgrip 115 and a second handgrip 116 are provided. Both the first handgrip 115 and the second handgrip 116 attach to the body 101 via a handgrip bracket 181. The handgrip bracket 181 enables either the first handgrip 115 or the second handgrip 116 to rotate with respect to the body 101.

The invention 100 can also be fitted with an optional customizable outer sleeve 107. The purpose of the customizable outer sleeve 107 is to provide additional insulation and to allow the user to apply customized art to the exterior of the invention 100. The customizable outer sleeve 107 is sized to fit over the body 101 of the invention 100. The customizable outer sleeve 107 is formed with a plurality of handgrip cutouts to accommodate handgrips 117, and a plurality of spout cutouts 123 to accommodate the plurality of dispensing spouts 103.

Figure 5:
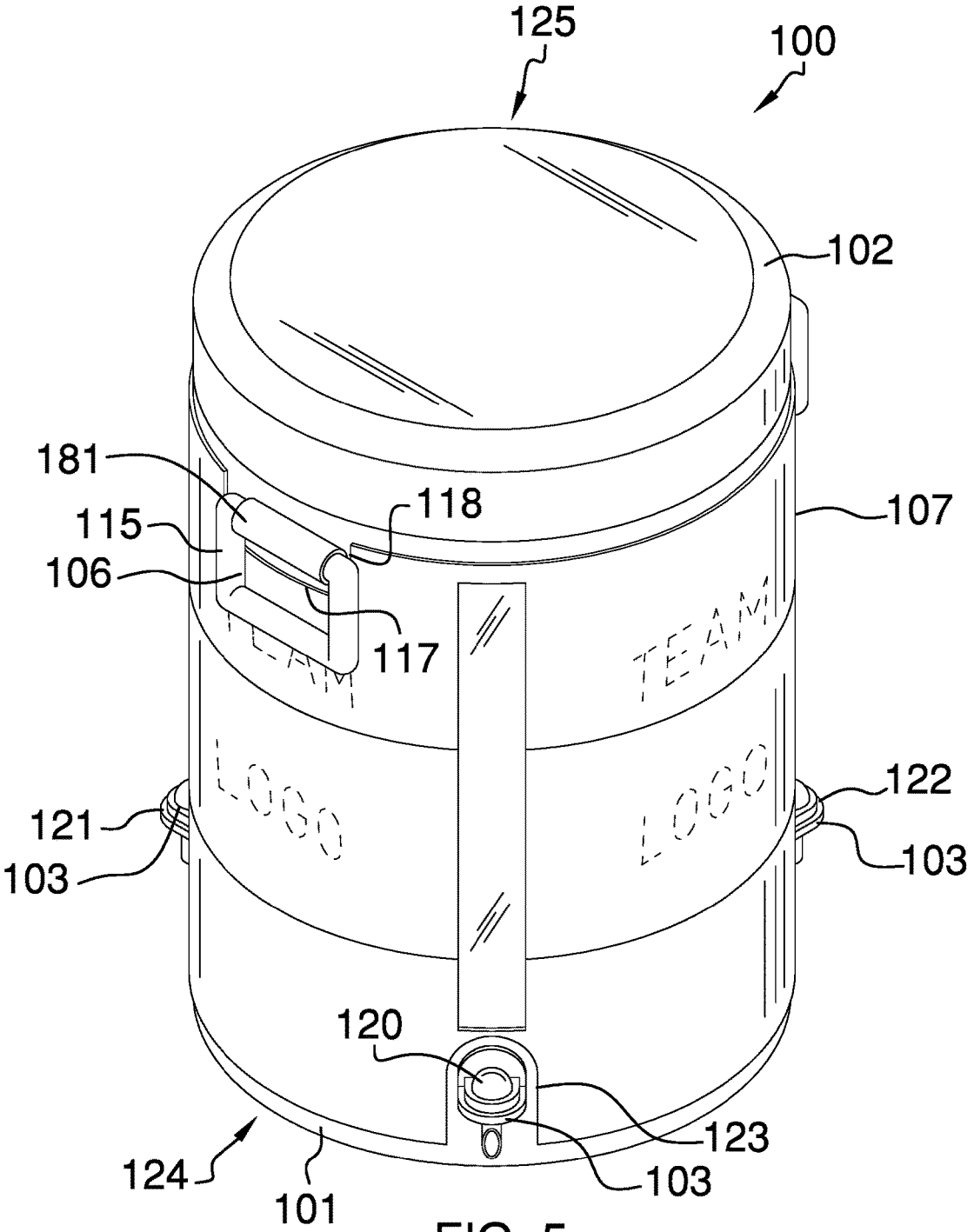
FIG. 5 shows another perspective view of the invention.

As shown in the first illustrative embodiment represented in FIG. 5, access through the customizable outer sleeve 107 to the first handgrip 115 and second handgrip 116 is provided through the first handgrip cutout 118 and the second handgrip cutout 119. Similarly, access through the customizable outer sleeve 107 to the first dispensing spout 120 is accommodated through an individual dispensing spout cutout 123.

The body 101 may include a volume-indicating window 177. The volume indicating window 177 is vertically oriented, made of a translucent material that enables a visible confirmation of a level of volume of fluid contained within the body 101. The outer sleeve 107 includes a window cutout 178 that corresponds with the volume-indicating window 177 of the body 101. The window cutout 178 enables visible confirmation as to the level of volume of fluid contained within the body 101 while having the outer sleeve 107 positioned on the body 101.

The invention 100 may also include a removable strap 182. The removable strap 182 is of an undefined length, and is used to secure to the plurality of handgrips 106 as an alternative measure for carrying the invention 100. The removable strap 182 is further defined with a first strap end 183 and a second strap end 184. Both the first strap end 183 and the second strap end 184 include a fastener 185 that is used to form a loop around one of the plurality of handgrips 106. Ideally, the fastener 185 is a snap button, or a button and hole combination, a hook and grommet, etc.

To use the invention 100, each of the individual beverage chambers 104 would be filled with a beverage of the user's choice. The selected beverages can be different in each individual beverage chamber 104. The removable lid 102 is then fitted to the top 125 of the invention 100. When desired, a user can then operate one of the plurality of dispensing spouts 103 to dispense the selected beverage into a container.

With respect to the above description, it is to be realized that the optimum dimensional relationship for the various components of the invention described above and in FIGS. 1-5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A multi-compartment beverage container comprising a body, a divider structure, a plurality of dispensing spouts, and a removable lid;

wherein the said body is comprised of a bottom and a body sidewall;

wherein the body is formed in the shape of a cylinder which is comprised of the body sidewall forming a curved outer surface, a top, said bottom, a length, and a diameter;

wherein the top of the body is open;

wherein the bottom and body sidewall provide for the exterior containment of at least one beverage therein;

wherein the divider structure is used to divide the interior volume of the body to form a plurality of beverage chambers;

wherein each of the plurality of beverage chambers is adapted to store a beverage therein;

wherein each of the plurality of beverage chambers are independent of one another, and keep the various beverages separated from one another;

wherein the divider structure is comprised of a plurality of panels;

wherein each of the plurality of panels spans a radius or half of the diameter of the body;

wherein each of the plurality of panels runs in the direction of the length of the body;

wherein the plurality of panels spans less than or equal to the overall length of the body;

wherein any two adjacent panels from the plurality of panels will provide the inner containment for each individual beverage chamber;

wherein the divider structure is used to segregate the interior volume of the body into a first beverage chamber, a second beverage chamber, and a third beverage chamber;

wherein the divider structure is comprised of a first panel, a second panel, and a third panel;

wherein the first panel and third panel combine to form inner walls of the first beverage chamber;

wherein the first panel and second panel combine to form inner walls of the second beverage chamber;

wherein the second panel and third panel combine to form inner walls of the third beverage chamber;

wherein the plurality of dispensing spouts is provided for the plurality of beverage chambers;

wherein a first dispensing spout controls the flow of liquid from the first beverage chamber;

wherein a second dispensing spout controls the flow of liquid from the second beverage chamber;

wherein a third dispensing spout controls the flow of liquid from the third beverage chamber;

wherein a removable lid is sized and designed for the purpose of sealing and insulating the open top of the body;

wherein the removable lid is further defined with a lip having an internal threading that corresponds with external threading provided at a top of the body in order for the removable top to be screwed onto and unscrewed from the body as needed;

wherein a plurality of beverage chamber seals is sandwiched between the divider and the removable top;

wherein the plurality of beverage chamber seals is further defined with a first beverage chamber seal fits securely in the first beverage chamber;

wherein a second beverage chamber seal fits securely in the second beverage chamber;

wherein a third beverage chamber seal fits securely in the third beverage chamber;

wherein the removable lid is made from a third piece molded plastic with a hollow space in the center;

wherein a core insulating material is injected therein;

wherein the top of the body is fitted with a plurality of handgrips;

wherein these handgrips are integrated into the design of the body sidewall to provide a convenient surface to grip and lift the body;

wherein a customizable outer sleeve is provided as additional insulation and to allow the exterior surface of the body to be customized;

wherein the customizable outer sleeve is sized to fit over the body, and is formed with a plurality of handgrip cutouts to accommodate handgrips of the body;

wherein the customizable outer sleeve includes a plurality of spout cutouts to accommodate the plurality of dispensing spouts;

wherein the body includes at least one volume-indicating window;

wherein the at least one volume indicating window is vertically oriented, made of a translucent material that enables a visible confirmation of a level of volume of fluid contained within the body;

wherein the outer sleeve includes a window cutout that corresponds with the at least one volume-indicating window of the body;

wherein the window cutout enables visible confirmation as to the level of volume of fluid contained within the body while having the outer sleeve positioned on the body;

wherein the plurality of handgrips is provided adjacent to and below the external threading at the top of the body;

wherein the plurality of handgrips is further defined as a first handgrip and a second handgrip;

wherein both the first handgrip and the second handgrip attach to the body via a handgrip bracket;

wherein the handgrip bracket enables either the first handgrip or the second handgrip to rotate with respect to the body;

wherein a removable strap is included and is used to secure to the plurality of handgrips as an alternative measure for carrying the multi-compartment beverage container;

wherein the removable strap is further defined with a first strap end and a second strap end;

wherein both the first strap end and the second strap end include a fastener that is used to form a loop around one of the plurality of handgrips.

* * * * *